United States Patent [19]

Raes

[11] 4,210,079

[45] Jul. 1, 1980

[54] ADVANCING CYLINDER FOR USE IN A PRINTING MACHINE

[76] Inventor: Karl Raes, Kantstr. 4, D-6201 Eppstein-Bremthal, Fed. Rep. of Germany

[21] Appl. No.: 902,097

[22] Filed: May 1, 1978

[30] Foreign Application Priority Data

Apr. 30, 1977 [DE] Fed. Rep. of Germany ..... 2719404

[51] Int. Cl.[2] ..... B41F 21/04; B65H 5/12; B65H 5/14

[52] U.S. Cl. ..... 101/242; 101/217; 101/246; 101/410; 101/411; 271/277

[58] Field of Search ..... 101/410, 409, 411, 246, 101/242, 217; 271/247, 277, 82, 196, 275, 276

[56] References Cited

U.S. PATENT DOCUMENTS

| | | | |
|---|---|---|---|
| 21,859 | 10/1858 | Wells | 101/410 |
| 137,347 | 4/1873 | Cottrell | 101/410 |
| 648,985 | 5/1900 | North | 101/410 |
| 1,128,390 | 2/1915 | Upham | 101/410 |
| 1,815,895 | 7/1931 | Bennison | 101/410 |
| 1,866,566 | 7/1932 | Horton | 101/410 |
| 2,056,922 | 10/1936 | Gegenheimer | 101/410 |
| 4,132,403 | 1/1979 | Weisbach et al. | 271/277 |

FOREIGN PATENT DOCUMENTS

| | | | |
|---|---|---|---|
| 583706 | 9/1933 | Fed. Rep. of Germany | 101/409 |
| 617107 | 8/1935 | Fed. Rep. of Germany | 101/409 |
| 473397 | 10/1937 | Fed. Rep. of Germany | 101/409 |
| 874917 | 4/1953 | Fed. Rep. of Germany | 101/409 |
| 1118811 | 12/1961 | Fed. Rep. of Germany | 101/409 |
| 1954559 | 5/1971 | Fed. Rep. of Germany | 101/409 |

*Primary Examiner*—J. Reed Fisher
*Attorney, Agent, or Firm*—Michael J. Striker

[57] ABSTRACT

A sheet advancing cylinder in an offset printing machine, has a sheet gripping system arranged in its interior. The system includes a rocking member rigidly connected to a first gripper for moving the latter between two terminal positions in a slot formed in the jacket of the cylinder. The movement of the rocking member is such that in the first terminal position the first gripper is flush with the jacket periphery, in an intermediate position it is above the periphery and in the second terminal position it is below the periphery.

24 Claims, 7 Drawing Figures

FIG. 3
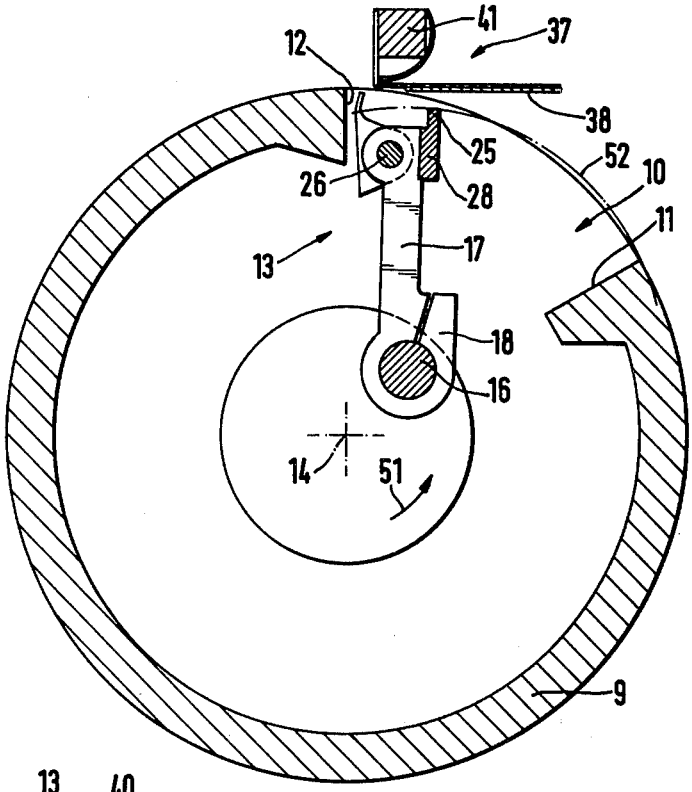
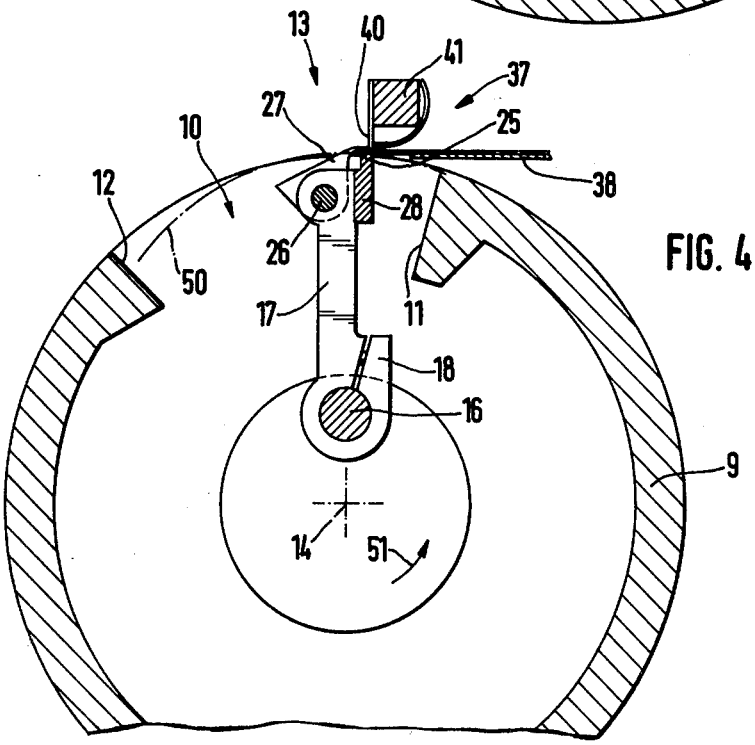
FIG. 4

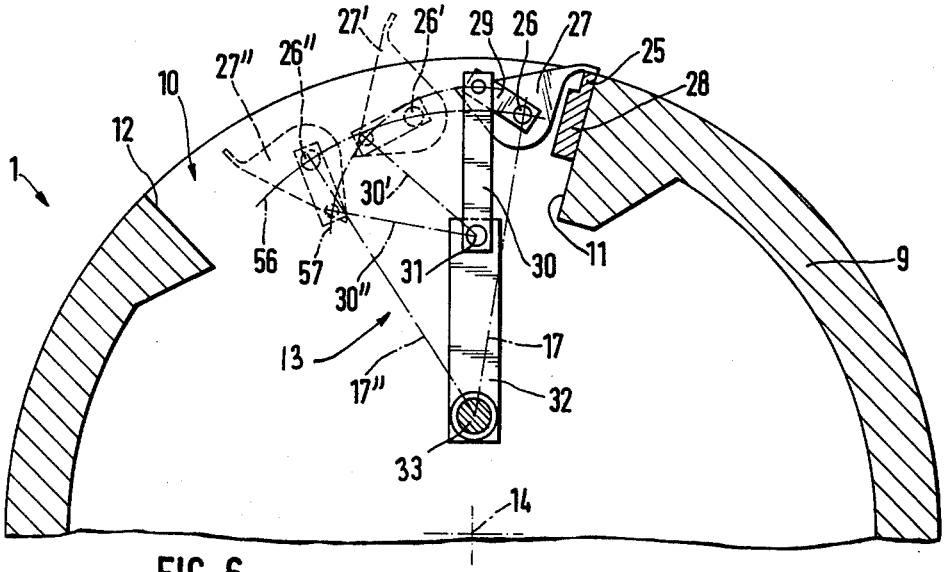
FIG. 6
FIG. 7
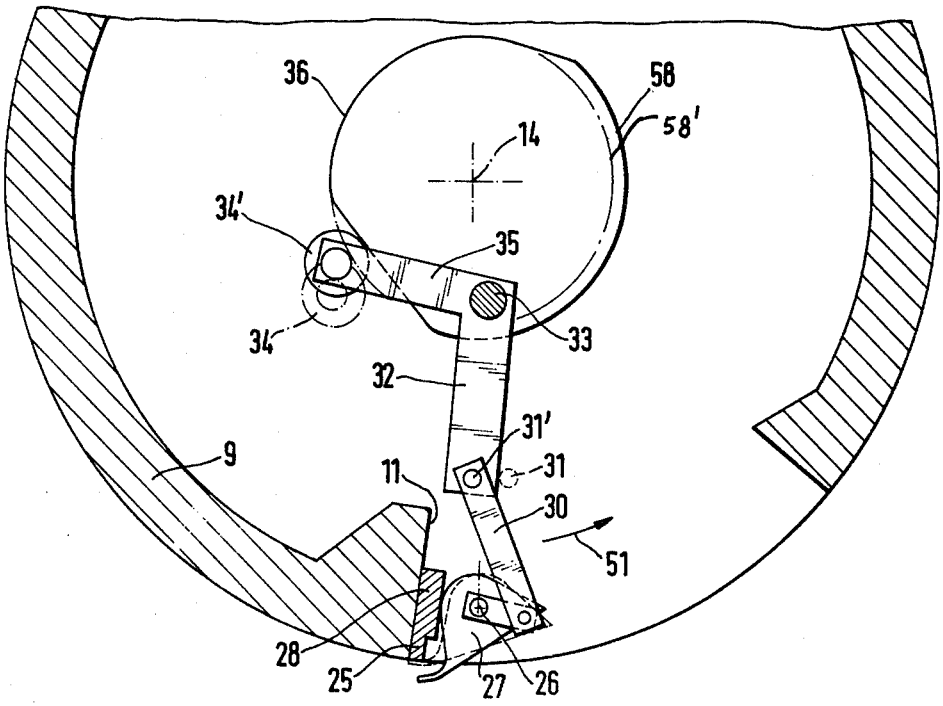

ADVANCING CYLINDER FOR USE IN A PRINTING MACHINE

BACKGROUND OF THE INVENTION

The present invention relates to an advancing cylinder for use in a printing machine, particularly in a high-speed offset printing machine, which has associated therewith an arrangement for transferring a respective sheet to be advanced through and printed upon in the printing machine, from a predetermined location on a support of the advancing cylinder, to a predetermined position on the periphery of the advancing cylinder.

It is well known that in printing machines, such as offset printing machines, in which images are to be printed on a series of sheets which are consecutively advanced through the printing machine, it is necessary to so transfer each respective sheet at least from the feeding table to the first advancing cylinder of the printing machine that the respective sheet assumes a predetermined position on the periphery of this advancing cylinder so that respective image or images is subsequently printed exactly on the desired zone of the respective sheet for each sheet of the series. Some conventional printing machines resort to the use of so-called stop drums or of rocking grippers which engage the respective sheet, which has been previously aligned and stopped on the feeding table or the like, and accelerate the respective sheet to the peripheral speed of the advancing cylinder to transfer the respective sheet to other grippers which are mounted in the advancing cylinder only when the respective sheet has achieved the above-mentioned peripheral speed of the advancing cylinder. In these conventional machines, a direct transfer of the respective sheet from its aligned and stopped position to the grippers of the advancing cylinders which orbit with and at the speed of rotation of the advancing cylinder, is no longer possible at high speeds of rotation of the advancing cylinder, especially in view of the fact that the accuracy of the positioning of the respective sheet on the advancing cylinder, which is especially, but not exclusively, required in multicolor printing, cannot be achieved under these circumstances. Thus, the utilization of the above-mentioned intermittently operating stop drums or rocking grippers was heretofore the precondition for achieving both high printing speeds and accurate positioning. However, these arrangements assume a substantial amount of space at the peripheral region of the advancing cylinder and simultaneously obstruct the view of the upstream end of the printing machine.

In order to avoid these difficulties, it has already been proposed in the German published patent application No. 1,954,559 to use only a single gripper system arranged in the interior of the advancing cylinder, particularly in a recess or depression thereof, the gripper system being mounted for rocking or pivoting relative to the advancing cylinder about the axis of rotation thereof. This internal gripper system is supposed to unite the functions of the heretofore customary external rocking grippers as well as of the cylinder grippers. This space-saving arrangement renders it possible not only to arrange an additional printing device at the periphery of the same advancing cylinder, but also to increase the printing speed as compared to what was possible before, particularly in view of the fact that, as a result of this particular construction, a separate rocking gripper system having a substantial rocking range and also comparatively high mass or inertia can be eliminated, and with it also an additional transfer of the respective sheet of the series.

It is also known from the German published patent application No. 1,118,811 to so construct a sheet-transfer system for a cylinder as to include grippers which are mounted on rocking arms which, in turn, are mounted on a pivot shaft which is arranged eccentrically to the axis of rotation of the cylinder. In this arrangement, the grippers emerge beyond the periphery of the cylinder during the movement of the rocking arms in their range of pivoting; however, the grippers of this conventional arrangement are actuated as to their movement by means of control pins which are stationarily arranged on the frame of the printing machine or a similar support and which engage suddenly. The movements which are produced in this manner are limited to the smallest angle of rotation of the cylinder so that high accelerations and relatively high instantaneous speeds are obtained.

SUMMARY OF THE INVENTION

Accordingly, it is a general object of the present invention to avoid the disadvantages of the prior art.

More particularly, it is an object of the present invention to so construct an advancing cylinder of the type here under consideration as not to be possessed of the disadvantages of the prior-art advancing cylinders.

A further object of the present invention is to so design the advancing cylinder and the associated equipment as to be able to achieve the printing speeds of 15,000 sheets per hour and more, while directly transferring the respective sheets from their aligned and stationary position on the feeding table to the advancing cylinder. It is still another object of the present invention to so construct the advancing cylinder unit as to have the minimum amount of parts which move relative to the advancing cylinder, and small masses to be accelerated, and thus a low level of dynamic imbalance.

An additional object of the present invention is to develop an advancing cylinder unit in which the grippers emerge beyond the periphery of the advancing cylinder during a simple movement thereof along a circular path.

Yet another object of the present invention is to so construct the advancing cylinder unit that that part of the periphery of the advancing cylinder which is not needed for the printing operation is utilized for the rocking motion of the gripper system in order to manage with relatively low accelerations even at substantial rotational speeds of the advancing cylinder.

A concomitant object of the present invention is to provide an advancing cylinder unit which is simple in construction, inexpensive to manufacture and reliable in operation.

Finally, it is an object of the present invention to devise an advancing cylinder unit which renders it possible to effect the transferal of the respective sheet from the feeding table to the periphery of the advancing cylinder in a condition of absolute standstill of the gripper system.

A further special object of the present invention is to so construct the gripper system of the unit and the associated front stop arrangement on the feeding table that they briefly arrestingly engage one another and thus eliminate the possibility of even minute positional variations of the sheet being transferred.

It is yet another special object of the present invention to make the arresting engagement of the gripper system with the front stop arrangement as soft as possible.

In pursuance of these objects and others which will become apparent hereafter, one feature of the present invention resides, in a printing machine, particularly in a high-speed offset printing machine, briefly stated, in a combination comprising a support; means for guiding a leading edge of a respective sheet to be advanced through and printed upon in the printing machine to a predetermined location of the support; an advancing cylinder mounted on the support for rotation in a given direction about a rotary axis and having a periphery which moves past the above-mentioned location during the rotation of the advancing cylinder, and a hollow interior which opens onto the periphery of the advancing cylinder; and means for transferring the respective sheet to a predetermined position on the periphery, the transferring means including a rocking component having a first gripping surface thereon, means for mounting the rocking component in the hollow interior of the advancing cylinder for pivoting in and opposite to the above-mentioned direction relative to the advancing cylinder about a pivot axis offset toward the periphery of the advancing cylinder from and parallel to the rotary axis, in a range between a first and a second terminal position through an intermediate position in which the first gripping surface is substantially flush with, inwardly offset from, and outwardly offset from the periphery of the advancing cylinder, respectively, the transferring means further including means for pivoting the rocking component in the above-mentioned range, including a cam track which is stationary with respect to the support and extends about the rotary axis, and a cam follower on the rocking component which follows the cam track and pivots the rocking component in the above-mentioned range in dependence on the configuration of the cam track, the transferring means further including a gripping component which has a second gripping surface and which is mounted on the rocking component for tilting relative thereto about a tilting axis to and from a gripping position in which the first and second gripping surfaces grip the respective sheet between themselves, and means for tilting the gripping component as a function of the pivoting movement of the rocking component in the above-mentioned range relative to the advancing cylinder. Advantageously, the rocking component includes a plurality of separate and parallel rocking arms mounted for joint pivoting, and a gripping element which extends between and is connected to the rocking arms and has the above-mentioned first gripping surface. It is further advantageous when the gripping component includes a plurality of individual gripping members each having a section of the above-mentioned second gripping surface thereon. It is particularly advantageous when the advancing cylinder includes a rear and a front limiting surface as considered in the above-mentioned direction, these limiting surfaces together bounding a passage that communicates the hollow interior with the periphery, and the rocking component being located at the rear limiting surface in the first terminal position thereof and next to the front limiting surface in the second terminal position thereof.

According to a currently preferred concept of the present invention, the pivoting means includes a lever rigidly connected to the rocking component, the cam track being configurated as a curved annular recess, and the cam follower being a roller rotatably mounted on the lever and received in the recess. Advantageously, the cam track is so configurated that the rocking component reaches the intermediate position thereof during the pivotal movement opposite to the above-mentioned direction when the first gripping surface is substantially at the above-mentioned location of the support during the rotation of the advancing cylinder in the above-mentioned direction. Then, the cam track is also so configurated that the first gripping surface of the rocking component comes to a brief substantial standstill at and relative to the above-mentioned location of the support during the pivotal movement of the rocking component opposite to, and during the rotation of the advancing cylinder in, the above-mentioned direction, particularly at the intermediate position of the rocking component relative to the advancing cylinder. The special advantages of this arrangement and especially of the movement of the gripper system will be individually discussed in the following discussion of an example of the embodiment of the present invention. In order to be able to arrestingly engage the gripper system with the sheet-feeding arrangement during the absolute standstill of the gripper system during the sheet transfer, the support is provided with at least one abutment and the rocking component has at least one engaging portion which contacts the abutment during the substantial standstill of the first gripping surface of the rocking component. Advantageously, a front stop component is mounted on the support and has at least two front stops which stop the leading edge of the respective sheet at the above-mentioned location of the support; then, the abutment may be rigidly connected to the front stop component. In this connection, it is particularly advantageous when the front stop component includes a shaft which mounts the front stops and the abutment on the support for joint pivoting in and out of the trajectories of movement of the respective sheet and of the engaging portion, respectively. Then, it is also advantageous to provide means for controlledly pivoting the front stop component about the above-mentioned shaft, including a control cam track on the advancing cylinder, a control lever rigid with the front stop component, and a control roller rotatably mounted on the control lever and following the control cam track. The control cam track is advantageously so configurated that the abutment is pivoted out of contact with and out of the trajectory of the engaging portions immediately prior to the commencement of movement of the rocking component in the above-mentioned direction following the substantial standstill of the first gripping surface thereof.

According to a currently preferred further facet of the present invention, one of the rocking and front stop components is mounted for limited resilient yieldability so that this one component can somewhat yield at the moment of contact of the engaging portion with the abutment, so that it is not only assured that the engaging portion indeed always and fully contacts the abutment in order to eliminate any possibilities of even minor discrepancies in the positioning of the sheet which may result from the vibrations of the front stops, but also a quiet operation of the advancing cylinder is achieved even at high speeds of rotation. In general, it is sufficient, provided accurate manufacture, when this elastic yieldability amounts to approximately 0.2 mm. When this elastic yieldability is provided at the abutment, it must be assured that the front stops of the front stop component are capable of exactly following the abutment in its movement so that the respective sheet can follow this movement of the front stops and thus of the abutment. This can be achieved, for instance, by giving the control cam track a single, outwardly facing cam surface, and by providing a spring as a part of the controlledly pivoting means, which spring urges the control roller into contact with the cam surface and thus provides the above-mentioned limited resilient yieldability.

On the other hand, it is also possible to immovably hold the front stop component with the front stops and the abutment thereof at least at the time of the transfer of the sheet, and to provide the elastic yieldability at the rocking component. Advantageously, this is obtained by configurating the control cam track as an annular control cam recess which receives and confines the control roller. Then, the mounting means of the rocking component is so constructed as to include a pivot shaft mounted on the advancing cylinder for pivoting about the pivot axis in dependence on the pivoting means for the rocking component, and by providing the limited resilient yieldability between the pivot shaft and the rocking component. In this context, it is particularly advantageous when the mounting means of the rocking component includes a bifurcated bracket rigid with the pivot shaft, and at least one spring arranged intermediate the bracket and the rocking component and urging the latter toward a given position thereof relative to the bracket.

The opening and closing movement of the gripping component during the transfer of the respective sheet advantageously is obtained by means of a positive control which is controlled by the relative movement of the rocking component itself. In this connection, it is proposed by the present invention to form the tilting means of the gripping component with a cam track segment which is rigid with the advancing cylinder and extends about the above-mentioned pivot axis, and with a push rod articulated through the gripping component and extending therefrom substantially along the rocking component in contact with the cam track segment. However, it is also proposed by the present invention and currently preferred to construct the tilting means of the gripping component as a toggle-lever arrangement which is articulated to the gripping component and to a reaction point provided on the advancing cylinder. A particular advantage of this toggle-lever arrangement is that it is possible to apply high gripping forces, which are needed in high-speed printing machines, where a simple gripper closing movement by means of a tension spring would generally no longer be sufficient. Advantageously, the toggle-lever arrangement includes a first toggle lever rigid with the gripping component and a second toggle lever pivotally connected to the first toggle lever at its one end and to the reaction point at the other end. It is particularly advantageous in this connection when the reacion point is substantially radially offset from the pivot axis. Then, it is further advantageous when the rocking component extends along a plane which includes the pivot axis and extends therefrom towards the periphery of the advancing cylinder, and when the second toggle lever extends along a substantially radial line of the advancing cylinder which passes through the reaction point and which encloses a predetermined angle in the above-mentioned direction with the above-mentioned plane, when the gripping component is in the gripping position thereof relative to the rocking component.

When it is desired to achieve a release of the respective sheet from the advancing cylinder while the rocking component still assumes its position of engagement and thus does not conduct any movement relative to the advancing cylinder, the opening of the grippers can be achieved by providing the tilting means of the gripping component with means for changing the position of the reaction point relative to the advancing cylinder, the changing means including a changing cam track on the support, and a changing cam follower which follows the changing cam track and is operatively connected to the reaction point. In this context, it is particularly advantageous when the changing means further includes means for mounting the reaction point on the advancing cylinder for movement in a part-circular path about the pivot axis. Instead, the tilting means could also be controlled from the exterior of the advancing cylinder in any other conventional manner. However, when the control is achieved by the above-mentioned changing cam track, it is possible to so configurate the changing cam track that the gripping component is accelerated away from and retarded toward the gripping position as compared to the tilting movement thereof attributable to the action of the tilting means as a function solely of the pivoting movement of the rocking component in the above-mentioned range.

A particular advantage of this construction is to be seen in the fact that it is sufficient when the tilting means tilts the gripping component in a tilting range which amounts at most to substantially 90°, and preferably to as little as substantially 15°. In view of the fact that the gripper system submerges into the interior of the advancing cylinder from time to time, it is not necessary to provide grippers which tilt backwardly almost completely, that is, by almost 180°, during their opening.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIGS. 3 to 5 are diagrammatic cross-sectional views of the advancing cylinder unit of FIG. 1 in three different positions thereof;

FIG. 6 is a diagrammatic partial cross-sectional view illustrating the tilting arrangement of the present invention; and FIG. 7 is a view corresponding to FIG. 6 but in a position of release of the sheet from the advancing cylinder unit.

DETAILED DISCUSSION OF THE PREFERRED EMBODIMENTS

Figure 1:
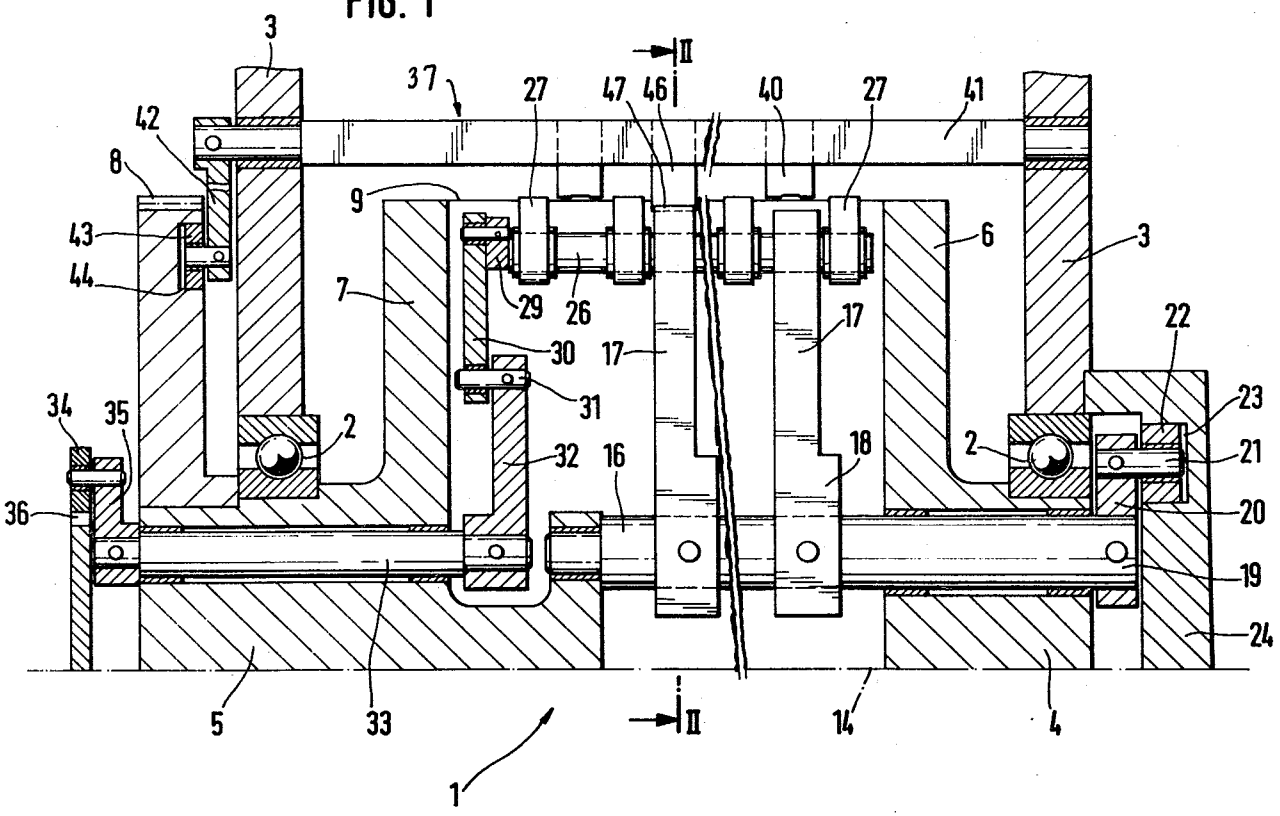
FIG. 1 is an axial sectional view of one half of the advancing cylinder unit of the present invention.

Referring now to the drawing in detail and first to FIG. 1 thereof, it may be seen that it illustrates a longitudinal section of a half of an advancing cylinder which is indicated in toto by the reference numeral 1. The advancing cylinder 1 is rotatably mounted in a machine frame or support 3 by means of ball bearings 2. The support 3 is, for instance, a part of the frame of an otherwise conventional offset printing machine for one color or multicolor printing. The illustrated advancing cylinder 1 is the first one of a plurality of cylinders as considered in the direction of advancement of the sheets to be printed with images in the printing machine, as is conventional. The advancing cylinder 1 is located immediately downstream of a conventional sheet feeding device which is so constructed, in a known manner, as to bring the paper sheets which are to be printed from a paper stack seriatim to an exactly defined location from where each respective sheet is to be transferred to the advancing cylinder 1, which may be the pressing cylinder of the first printing station of the printing machine. As also known from conventional printing machines, when the printing machine is an offset printing machine, the printing station of the printing machine also includes a blanket cylinder and a plate cylinder, as well as arrangements for moistening and inking the offset printing plate with a printing ink. The printing ink is transferred from the plate cylinder in a distribution corresponding to the image to be printed, to the blanket of the blanket cylinder and therefrom, in turn, to the respective sheet which is entrained for joint movement with the periphery of the advancing cylinder 1.

Conventional offset printing machines of this type are so well known that it is deemed not to be necessary to describe the conventional components of these offset printing machines in any more detail, except as needed for the understanding of the present invention. However, it is to be emphasized that, particularly during the printing of a multicolor image, wherein corresponding images of the various colors are sequentially printed on the same paper sheet either in a single passage of the sheets through the printing machine or in a plurality of individual passages of the respective sheet through the printing machine, the sheets to be printed must be brought into an exactly defined position on each advancing cylinder 1, in order to achieve that the images of the individual colors are printed on top of one another in an exact registry with each other.

The advancing cylinder 1 which is illustrated in FIG. 1 includes two cylindrical hubs 4 and 5 which are respectively adjoined by end walls 6 and 7 of the advancing cylinder 1. The cylindrical hub 5 is further provided with a driving gear annulus 8 which meshes with a non-illustrated driving system. A cylindrical jacket 9 extends between the end walls 6 and 7 of the advancing cylinder 1, the cylindrical jacket 9 being best seen in FIGS. 3 to 6.

As also seen in these figures, the cylindrical jacket 9 is formed with a slit or passage 10 which extends over the entire axial length of the cylinder 1. The passage 10 is bounded by a front limiting surface 11 and a rear limiting surface 12. A gripper system which will be discussed in more detail below is accommodated in the passage 10 and in the interior of the advancing cylinder 1, the gripper system in its totality being generally designated with reference numeral 13. The advancing cylinder 1 is mounted for rotation about a rotary axis 14, and rotates thereabout during the operation of the printing machine.

Figure 5:
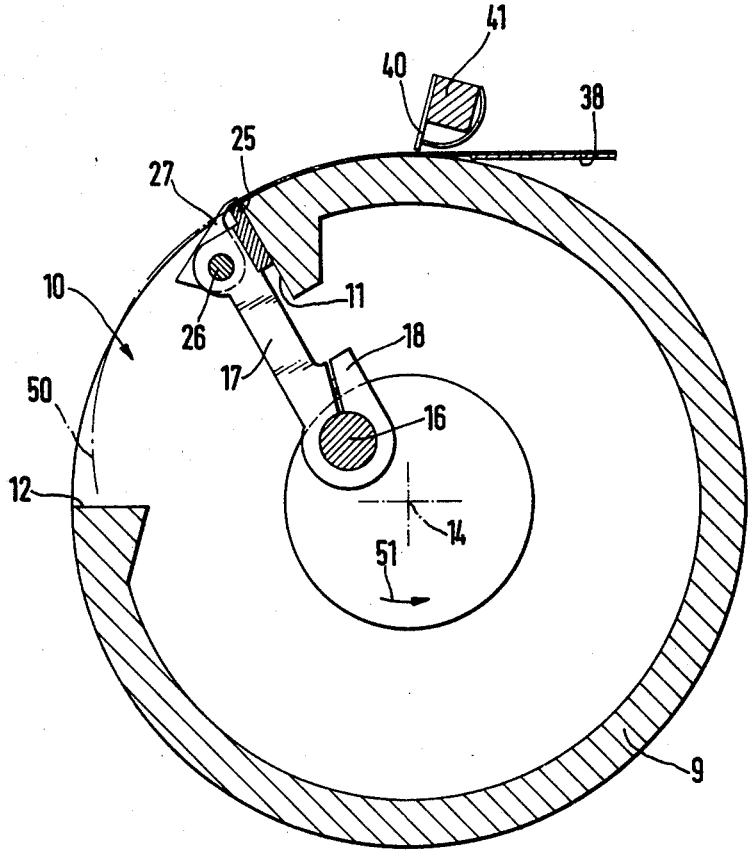

It will be appreciated that FIGS. 1 and 6 illustrate only that half of the advancing cylinder 1 which is provided with the passage 10. For this reason, the illustration of these figures is limited by the rotary axis 14. The non-illustrated half of the advancing cylinder 1 includes, essentially, only a mirror-image repetition of the cylindrical hubs 4 and 5 with the end walls 6 and 7 as well as the cylindrical jacket 9. However, a diagrammatic but complete sectional view of the advancing cylinder 1 is shown in FIGS. 3 to 5. Furthermore, FIG. 1 has been shortened in the axial direction thereof by the omission, as indicated by wavy lines, of repetitious elements of the advancing cylinder 1.

As seen in FIGS. 1 through 5, the gripper system 13 includes a pivot shaft 16 which is pivotally mounted in the cylindrical hubs 4 and 5 of the advancing cylinder 1 eccentrically to the rotary axis 14, and more particularly at the side of the passage 10. A plurality of rocking arms 17 all of which extend in the same radial direction, is affixed to the pivot shaft 16. Because of the omission on the central part from FIG. 1, only two of the rocking arms 17 are illustrated. The rocking arms 17 can be connected to the pivot shaft 16, for instance, as illustrated in FIGS. 3 to 5, in a diagrammatic manner, by means of slotted clamping sleeves 18. When the pivot shaft 16 is pivoted about its pivot axis, the rocking arms 17 move within the passage 10 along a part-circular trajectory, between the front limiting surface 11, and a position next to the rear limiting surface 12, in and opposite to the direction of rotation of the advancing cylinder 1.

As particularly seen in FIG. 1, the pivoting movement of the pivot shaft 16 and of the rocking arms 17 affixed thereto is controlled in such a manner that the pivot shaft 16 is extended beyond the cylindrical hub 14 so that an end portion 19 of the pivot shaft 16 is located exteriorly of the advancing cylinder 1, that a control lever 20 is rigidly connected to and extends radially of the pivot shaft 16, that a pin 21 extends in axial parallelism through the free end of the control lever 20, and that a cam follower roller 22 is rotatably supported on the pin 21 to the side of the control lever 20. This cam follower roller 22 rolls along a cam track 23 during the rotation of the advancing cylinder 1. As may be seen in FIG. 2 which illustrates the configuration of the cam track 23, the latter circumferentially completely surrounds the rotary axis 14. Preferably, as illustrated in FIG. 1, the cam track 23 is a cam track recess which is provided in a cam track disc 24 that is rigidly connected to the machine frame or support 3.

The rocking arms 17 are connected with one another at their outer ends by a gripping element 28 which has a frist gripping surface 25 thereon. A tilting shaft 26 extends through the rocking arms 17 parallel to the gripping element 28, the tilting shaft 26 being mounted in the rocking arms 17 for rotation. Gripping members 27 are rigidly connected to the tilting shaft 26, the gripping members 27 respectively cooperating with the first gripping surface 25.

As particularly clearly seen in FIGS. 1 and 6, the tilting shaft 26 is rigidly connected, at one of its ends, with an actuating lever 29 which, in turn, is articulated to a toggle lever 30. This toggle lever 30 is pivotally connected, via a pin 31, with a control lever 32, the control lever 32 being rigidly connected to an end of a control shaft 33 which is turnably supported in the cylindrical hub 5 in an axial continuation of the pivot shaft 16. The control shaft 33 passes through the cylindrical hub 5 to the exterior of the advancing cylinder 1.

As seen in FIGS. 1 and 7, the control shaft 33 carries on its outer end a cam track follower lever 35 which has a cam follower roller 34 mounted thereon. The cam track follower roller 34 follows a control cam track 36 which is stationarily provided on the support 3 about the axis of the control shaft 33. In order to more clearly bring forward the fact that the control lever 32 and the cam track control lever 35 are not articulated to one another but rather are rigidly connected with one another around the control shaft 33, these two levers 32 and 35 are illustrated in FIG. 7 as a one-piece bell crank lever, even though the control shaft 33 is located between these levers 32 and 35. An exemplary configuration of the control cam track 36 is also indicated in FIG. 7.

Figure 2:
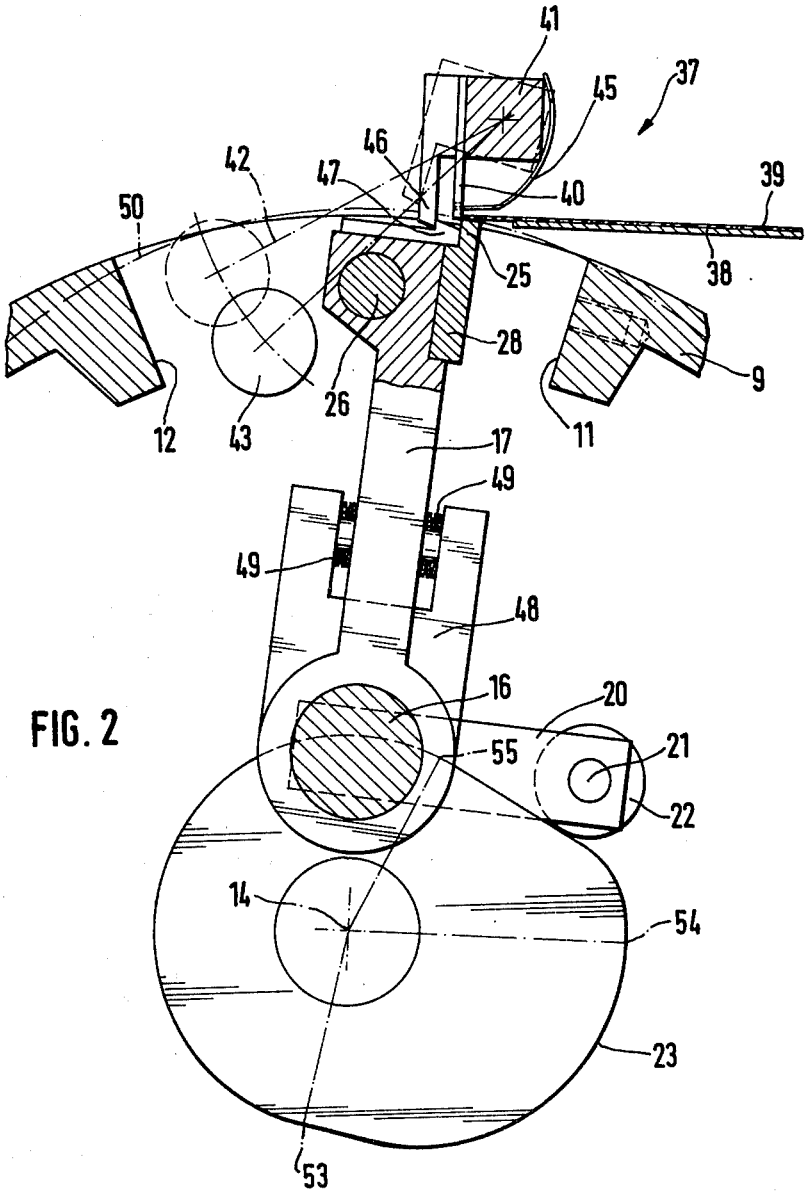
FIG. 2 is a simplified cross-sectional view taken on line II—II of FIG. 1 in a transfer position of the advancing cylinder unit.

Parts of a sheet feeder, which is designated in general with the reference numeral 37, are illustrated in FIGS. 1 and 2 upwardly of the advancing cylinder 1. The sheet feeder 37 is stationarily mounted on the support 3. The reference numeral 38 indicates a sheet-support member which supports a paper sheet 39 which is to be transferred to the advancing cylinder 1. In order to determine the exact location of the leading edge of the paper sheet 39 which is being constantly pushed toward the advancing cylinder 1, there is provided a so-called front stop unit 40 on the sheet feeder 37. The front stop unit 40, which includes downwardly pointing tongues of sheet metal is mounted on a front stop rod 41 which, in turn, as seen particularly in FIG. 1, is pivotally and laterally mounted in the support 3. A front stop lever 42 is mounted on an end portion of the front stop rod 41 which extends to the exterior of the support 3, a cam follower roller 43 being rotatably mounted on the free end of the front stop lever 42 and serving to follow a front stop control cam track 44 which, in the exemplary embodiment of FIG. 1, is provided as an annular recess formed in the driving gear annulus 8. The front stop control cam track 44 controls the lifting and lowering of the front stop unit 40.

The front stop lever 42 and the cam track roller 43 are only indicated in FIG. 2. Furthermore, a registering stop 45 is also mounted on the front stop rod 41, the registering stop 45 consisting of an elastically deformable metal sheet which can be adjusted as to its elevation above the paper sheet 39 by non-illustrated conventional means. The registering stop 45 serves to press the leading edge portion of the sheet 39 against the feeding surface 38.

Furthermore, as also seen in FIGS. 1 and 2, the front stop rod 41 is provided preferably at least with two abutments 46, of which only one is illustrated in the drawing. The abutment 46 cooperates with an engaging portion 47 which is provided at the outermost region of one of the rocking arms 17. These two elements are to be engaged with one another during the transferal of the sheet 39, in order to avoid positional inaccuracies such as those caused by the vibrations of the rocking arms 17.

In FIG. 2, there is further illustrated a somewhat different kind of the attachment of the rocking lever 17 to the pivot shaft 16. In this embodiment, a bifurcated entraining member 48 is rigidly connected to the pivot shaft 16, such as being clamped thereto, and the rocking lever 17 freely extends between the two prongs of the bifurcated entraining member 48. Under these circumstances, the rocking arm 17 is mounted on the pivot shaft 16 for a limited angular displacement thereabout. Springs, such as dish springs 49 are arranged at both sides between the respective rocking arm 17 and the bifurcated entraining member 48, which permit the rocking arm 17 to conduct a limited elastically opposed movement relative to the bifurcated entraining member 48 and thus to the pivot shaft 16. These dish springs 48 provide for a certain yieldability of the rocking arm 17 at the time of contact of the engaging portion 47 with the stationary abutment 46, on the one hand, and for a somewhat softer contacting of the gripping element 28 with the front limiting surface 11 of the advancing cylinder 1 during the transition of the gripping system 37 into the engaging position.

Having so basically discussed the construction of the arrangement of the present invention, the operation thereof will now be briefly discussed, first with reference to FIGS. 7 and 3 to 5 which illustrate the relative movement of the respective rocking arm 17 within the passage 10 during the rotation of the advancing cylinder 1. It will be noted that the rocking arm 17 is not illustrated in FIG. 7, but the position thereof is indicated by the fact that the first gripping surface 25 is located at the front limiting surface 11 of the advancing cylinder 1, which means that the respective rocking arm 17 is in the engaging position thereof. FIG. 7 illustrates the advancing cylinder 1 at that angularly displaced position where the advancing operation of the advancing cylinder 1 has already been terminated and the gripping members 27 have been slightly opened in order to release the previously printed sheet 39. During the further rotation of the advancing cylinder 1 in the direction of the arrow 51, the rocking arms 17 move away from the front limiting surface 11 at a higher absolute speed than the periphery of the advancing cylinder 1, until the gripping system 37 assumes the position illustrated in FIG. 3 after approximately one-half of a revolution of the advancing cylinder 1. The part-circular trajectory which is traversed by the first gripping surface 25 during this movement is indicated with the reference numeral 50. Thereafter, that is, following the movement of the first gripping surface 25 out of its engaging position illustrated in FIGS. 5 and 7 in which the first gripping surface 25 is substantially flush with the periphery of the advancing cylinder 1, the first gripping surface 25 emerges only at approximately a point 52 beyond the periphery of the advancing cylinder 1, to again submerge below the periphery so that, in its terminal position in the vicinity of the rear limiting surface 12, the gripping system 13 is so located that even the gripping members 27 which assume their open positions do not project beyond the outer periphery of the advancing cylinder 1. The emerged position 52 illustrated in FIG. 3 during the movement of the rocking arms 17 relative to the advancing cylinder 1 in the direction 51 is achieved already at such an angle of the advancing cylinder 1 at which the gripping system 13 is still spaced by a sufficient angle from the supporting member 38 and from the front stop 40 so that no danger of collision with these parts exists. Before passing the front stop 40, the gripping system 13 has receded already so far into the passage 10 that it can pass by the front stop 40 even when the gripping members 27 are in their open positions. This has the advantage that the front stop member 40 can be lowered very early ahead of the commencement of the transfer of a new sheet 39.

It will become apparent from FIGS. 3 and 7 that almost a third of a rotation of the advancing cylinder 1 is available for the movement of the rocking arms 17 in the direction 51 from the engaging position after the release of the sheet 39 until the submerged position of FIG. 3. For this reason, the relative movement can be accomplished at relatively low acceleration. The sheet-release position of FIG. 7 is indicated at the cam track 23 of FIG. 2 as 53 and the submerged position of FIG. 3 is indicated on the cam track 23 approximately by 54. Commencing at the submerged position of the gripping system 37 illustrated in FiG. 3, the rocking arms 17 are moved opposite to the direction 51 relative to the advancing cylinder 1 so that absolute movement is being decelerated. This is caused by the steep incline of the cam track 23 as seen in FIG. 2. While the advancing cylinder 1 continues its rotation out of the position illustrated in FIG. 3, the rocking arms 17, because of their opposite relative movement, come substantially to an absolute standstill, while they approach the summit of the movement trajectory 50 because of their opposite rotation within the passage 10, whereby the first gripping surface 25 emerges out of the passage 10. The rocking arms 17 move only slightly in the direction 51 of rotation of the advancing cylinder 1, until the engaging portions 47 of the rocking arms 17 abut the abutments 46 of the front stop rod 41 which are in their lowered positions. This situation is illustrated in FIG. 2 in which, however, in order not to unduly encumber the drawing, the gripping members 27, which assume their fully open position, have been omitted. At the instant at which the contact between the engaging portion 47 of the rocking arm 17 and the abutment 46 of the front stop rod 41 is established, the rocking arms 17 acquire a brief condition of absolute standstill, during which the transfer of the sheet 39 takes place.

A particularly perfect positioning of the sheet 39 during the transferal of the sheet 39 to the advancing cylinder 1 is achieved when the engaging portion 47 and the abutment 46 contact one another accurately while a certain elastic yieldability is built into at least one of the components which carry the engaging portion 47 and the abuutment 46, in order to eliminate any inaccuracies in the transferal of the sheet 39 to the advancing cylinder 1, which may be caused by vibrations, particularly of the rocking arms 17, between the latter and the front stop unit 40.

In the embodiment illustrated in FIG. 2, this elasticity is incorporated in the mounting arrangement for the rocking arms 17. The dish-shaped spring 49 which are arranged to the right from the rocking arm 17 permit an elastic yielding during even a minute further movement of the entraining member 48 by the pivot shaft 16. When the various parts are manufactured in accordance with specifications, and properly adjusted, a play of 0.2 mm usually suffices in order to obtain an excellent accuracy of the transferal.

Instead of the rocking arm 17, the entire front stop unit consisting of the front stop rod 41, the front stop 40, and the abutment 46 can be mounted for elastic yieldability. This can be easily achieved when the front stop control cam track 44, which is illustrated in FIG. 1 as a recess, is formed only as a one-sidedly limited cam track against which the cam follower roller 43 which is mounted on the lever 42 is pressed by a conventional spring. The elasticity of this spring can then be so selected that a desired yieldability of the abutment 46 is achieved. It is self-evident that the front stop 40 must be able to always exactly follow these movements inasmuch as the sheet 39 to be transferred could not be properly positioned.

During the absolute standstill of the rocking arms 17, the gripping members 27 close around and firmly grip the sheet 39 to be transferred. This position is illustrated in FIG. 4. Immediately thereafter, the cam follower roller 43 of the front stop lever 42 encounters, during the further rotation of the advancing cylinder 1, an inclined portion on the front stop control cam track 54 which rotates with the advancing cylinder 1, as a result of which the front stop rod 41 is tilted and the abutment 46 together with the front stop 40 are lifted in order to release the gripping system 13 for the renewed acceleration thereof to the peripheral speed of the advancing cylinder 1. The raised position of the front stop rod 41 is illustrated in FIG. 2 by dash lines. In addition thereto, there are indicated the corresponding positions of the front stop lever 42 and of the cam follower roller 43. Subsequently thereto, the rocking arms 17 are accelerated from their absolute rest again in the direction 51; however, a further relative lag with respect to the advancing cylinder 1 still takes place until the gripping element 28 connected to the rocking arms 17 again abuts the front limiting surface 11. During this relative lag, the first gripping surface 25 again submerges into the passage 10 to such an extent that it becomes flush with the periphery of the advancing cylinder 1. From the instant of the engagement of the gripping element 28 with the front limiting surface 11, the gripping system 37 has again reached the peripheral velocity of the advancing cylinder 1 and assumes the engaging position illustrated in FIG. 5 in which the paper sheet 39 can be printed upon by the non-illustrated printing unit. The achievement of the engaging position is indicated approximately by the reference numeral 55 on the curve 23 of FIG. 2. The rest position of the rocking arms 17 for the sheet transferal is located slightly ahead of the highest point of the advancing cylinder 1 in order to assure that, subsequently, the sheet 39 will be initially moved in a substantially horizontal direction from the feeding support 38.

It may be easily ascertained from the configuration of the cam track 23 of FIG. 2 and from the different illustrations of FIGS. 3 and 5 that an angle of approximately 70° to 90° is available for the entire movement of the gripping system 13 for the transferal of the sheet 39, from the submerged position of FIG. 3 to the engaging position of FIG. 5. This angle is greater than the angle assumed by the passage 10 with respect to the rotary axis 14. Alone for the absolute standstill of the rocking arms 17 of the gripping system 13 immediately during the transferal of the sheet 39 there is available a cylinder angle of 20° to 30° . As a result of this, there are obtained, even at higher rotary speed of the advancing cylinder 1, very advantageous movements with relatively low accelerations.

The opening and closing movement of the gripping members 27 per se during the course of movement of the rocking arms 17 is apparent from FIG. 6. The positions of the gripping members 27 which correspond to three different positions of the rocking arms 17 which are not shown in FIG. 6, are caused by the pivoting movement of the rocking arms 17. The position of the rocking arms 17 is only indicated by the respective position of the pivot shaft 26 which, therefore, and for the sake of a better illustration, is connected by a dash-dotted line with the control shaft 34 for the two terminal positions, in view of the fact that the control shaft 34 is coaxial with the pivot shaft 16.

During the entire course of the movement of the gripping members 27 which is illustrated in FIG. 6, the control lever 32, and thus also the reaction point 31 of the toggle lever 30 is arrested with respect to the advancing cylinder 1. Now, when the tilting shaft 26 is moved leftwardly due to the pivoting movement of the rocking arms 17, along the circular arm 56 toward the submerged position 26' of the gripping system 13, the toggle lever 30 pivots along a circular arc 57 through a position 30' into a position 30'', so that the distance of its outer end from the periphery of the advancing cylinder 1 increases more pronouncedly than the distance of the tilting shaft 26 from the periphery of the advancing cylinder 1, because of the smaller pivoting radius of the toggle lever 30. As a result of this, the toggle lever 30 pulls the gripper lever 29 toward the central part of the advancing cylinder 1, so that the gripping member 27 is transferred from its closing position illustrated in heavy lines into its opening position 27' and 28''. It is clearly apparent from FIG. 6 that the gripping member 27, when its open position 27'', submerges below the periphery of the advancing cylinder 1 to such an extent that no part of the gripping member 27 projects beyond the periphery of the advancing cylinder 1 even in the fully open position 27'' of the gripping member 27. As a result of this, it is not necessary in the arrangement according to the present invention to fully tilt the gripping member 27 by approximately 180° into its open position, as it was the case in most of the known gripping systems, in order to be able to move the gripping member 27 underneath the support surface 38 and the front stop 40. Thus, the exists a possibility in this arrangement of the present invention to open the gripping member 27 to the extent of only approximately 90°, as it is, for instance, shown in FIG. 3. This, in turn, results in a shortening of the moving distance as compared to the conventional systems and thus in an endorsement of high printing speeds. Contrary to known grippers, which have to be necessarily opened through an angle of approximately 180°, it is even possible with the toggle-lever system of the present invention to so construct the latter as to obtain any desired arbitrary opening angle of the gripping members 27. Should this prove to be necessary at the highest printing speeds, it is merely necessary to open the gripping members 27 through an angle of approximately 15°.

The reaction point 31 of the toggle lever 30 is advantageously so arranged that the toggle lever 30 assumes a radial orientation in the closed position of the gripping members 27.

Basically, it would be possible to open the gripping members 27 after the termination of the printing operation for releasing the sheet 39, in the same manner as discussed above, by letting the rocking arms 17 advance from their engaging positions in which they no longer have to remain after the termination of the printing operation, in the direction 51 relative to the advancing cylinder 1. Inasmuch as the gripping members 27 need only be opened slightly for the release of the sheet 39, a small forward pivoting of the rocking arms 17 would be quite sufficient to achieve this. However, at high advancement or printing speeds, it could happen that too high tensioning forces would be applied to the paper sheet 39 which is trained about the periphery of the advancing cylinder 1. Thus, it has been proven to be advantageous to achieve the opening of the gripping members 27 for the release of the sheet 39 not as a result of the relative movement of the rocking levers 1, but rather with the aid of a separate control arrangement which is illustrated in FIG. 7.

An opening of the gripping members 27 is here achieved, in the absence of any relative movement of the rocking arms 17, in such a manner that the reaction point 31 of the toggle lever 30 is displaced by tilting the control lever 32 about the control shaft 33, into a position which is indicated by the reference numeral 31' in FIG. 7. The tilting movement of the control lever 32 is achieved in such a manner that a cam track follower lever 35 which is rigidly connected to the control lever 32 through the control shaft 33, cooperates with a flattened region of the control cam track 36. After the release of the sheet 39, the follower roller 34 of the follower lever 35 could naturally be returned to an original constant radius of the control cam track 36, which is indicated at 58 in FIG. 7, inasmuch now there comes into existence an advancement of the rocking arms 17 with respect to the advancing cylinder 1, during which advancement the gripping members 27 will be opened anyway in correspondence to the illustration of FIG. 6.

However, when it is desired to make the opening and closing movement of the gripping members 27 somewhat different during the forward and rearward tilting of the rocking arms 17, then an additional movement component can be superimposed on the basic opening and closing movement of the gripping members 27 in accordance with the illustration of FIG. 6 by simultaneously pivoting the control lever 32 to thereby change the position of the reaction point 31. Inasmuch as the control cam track 36 is anyway needed for the release of the sheet 39, it can be provided, for the above-mentioned purpose, and without encountering any difficulties, with a corresponding cam section indicated at 58' in FIG. 7 in the region of the sheet transferal, which deviates from the normal configuration indicated at 58 corresponding to the normal position of the reaction point 31. It has been found to be especially advantageous when this additional control possibility is so utilized that the last phase of the closing movement of the gripping members 27 during the sheet transferal is retarded in order to achieve a soft engagement of the gripping members 27 with the front edge portion of the paper sheet 39 which rests on the first engaging surface 25.

It is further to be pointed out that, especially during the rearward movement of the control lever 32 from its displaced position indicated in FIG. 7 by the position 31' of the reaction point 31 into its normal position, indicated by the reaction point 31 in FIG. 7, as determined by the configuration of the control cam track 36, there is obtained a toggle-lever effect inasmuch as the toggle lever 30 constitutes a straight-line continuation of the control lever 32 in the normal position, that is, when the gripping members 27 are closed. Because of this toggle-joint effect, it is possible to effortlessly achieve the high gripping forces which are needed especially when the printing machine works at high operating speeds, which would no longer to possible to achieve with spring-biased grippers while keeping the forces and the amount of work involved in opening and closing the grippers still within acceptable limits.

As can be ascertained from the description of the exemplary embodiments illustrated in the drawings, the construction according to the invention results in an advancing cylinder which renders it possible to directly transfer the sheets to be printed upon from their rest position on the feeding table of the feeding device onto the advancing cylinder, even at the highest operating speeds of the printing machine, and while achieving a first-class accuracy of transfer. All this is attributable to the relatively small amount of parts which move relative to the advancing cylinder, and to the relatively small relative accelerations which are necessary to move these parts.

It will be understood that each of the elements described above, or two or more together, may also find a useful application in other types of constructions differing from the types described above.

While the invention has been illustrated and described as embodied in an advancing cylinder for use in high-speed offset printing machines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an offset printing machine, a combination comprising a support; means for guiding a leading edge of a respective sheet to be advanced through and printed upon in the printing machine to a predetermined location of said support; an advancing cylinder mounted on said support for rotation in a given direction about a rotary axis and having a periphery which moves past said location during the rotation of said advancing cylinder, and a hollow interior which opens onto said periphery; and means for transferring the respective sheet to a predetermined position on said periphery, including a rocking component having a first gripping surface rigidly connected thereto, means for mounting said rocking component in said hollow interior for pivoting in and opposite to said direction relative to said advancing cylinder about a pivot axis offset toward said periphery from and parallel to said rotary axis, in a range between a first terminal position in which said first gripping surface is substantially flush with said periphery, through an intermediate position in which said first gripping surface is above said periphery, and a second terminal position in which said first gripping surface is below said periphery, means for pivoting said rocking component in said range, including a cam track which is stationary with respect to said support and extends about said rotary axis, and a cam follower on said rocking component which follows said cam track and pivots said rocking component in said range in dependence on the configuration of said cam track, a gripping component having a second gripping surface and mounted on said rocking component for tilting relative thereto about a tilting axis to and from a gripping position in which said first and second gripping surfaces grip the respective sheet between themselves, and means for tilting said gripping component as a function of the pivoting movement of said rocking component in said range relative to said advancing cylinder.

2. A combination as defined in claim 1, wherein said rocking component includes a plurality of separate and parallel rocking arms mounted for joint pivoting, and a gripping element which extends between and is connected to said rocking arms and has said first gripping surface.

3. A combination as defined in claim 1, wherein said gripping component includes a plurality of individual gripping members each having a section of said second gripping surface thereon.

4. A combination as defined in claim 1, wherein said advancing cylinder includes a rear and a front limiting surface as considered in said direction, which together bound a passage that communicates said hollow interior with said periphery; and wherein said rocking component is located at said rear limiting surface in said first terminal position, and next to said front limiting surface in said second terminal position thereof.

5. A combination as defined in claim 1; wherein said pivoting means includes a lever rigidly connected to said rocking component; wherein said cam track is configurated as curved annular recess; and wherein said cam follower is a roller rotatably mounted on said lever and received in said recess.

6. A combination as defined in claim 1, wherein said cam track is so configurated that said rocking component reaches said intermediate position thereof during the pivotal movement opposite to said direction when said first gripping surface is substantially at said location of said support during the rotation of said advancing cylinder in said direction.

7. A combination as defined in claim 6, wherein said cam track is so configurated that said first gripping surface of said rocking component comes to a brief substantial standstill at and relative to said location of said support during the pivotal movement of said rocking component opposite to, and during the rotation of said advancing cylinder in, said direction.

8. A combination as defined in claim 7; further comprising at least one abutment on said support; and wherein said rocking component has at least one engaging portion which contacts said abutment during said substantial standstill of said first gripping surface of said rocking component.

9. A combination as defined in claim 8; and further comprising a front stop component mounted on said support and having at least two front stops which stop the leading edge of the respective sheet at said location of said support; and wherein said abutment is rigidly connected to said front stop component.

10. A combination as defined in claim 9, wherein said front stop component includes a shaft which mounts said front stops and said abutment on said support for joint pivoting in and out of the trajectories of movement of the respective sheet and of said engaging portion, respectively.

11. A combination as defined in claim 1, wherein said tilting means tilts said gripping component in a tilting range which amounts to 90°.

12. In an offset printing machine, a combination comprising a support; means for guiding a leading edge of a respective sheet to be advanced through and printed upon in the printing machine to a predetermined location of said support; an advancing cylinder mounted on said support for rotation in a given direction about a rotary axis and having a periphery which moves past said location during the rotation of said advancing cylinder, and a hollow interior which opens onto said periphery; and means for transferring the respective sheet to a predetermined position on said periphery, including a rocking component having a first gripping surface thereon, means for mounting said rocking component in said hollow interior for pivoting in and opposite to said direction relative to said advancing cylinder about a pivot axis offset toward said periphery from and parallel to said rotary axis, in a range between a first terminal position and a second terminal position through an intermediate position in which said first gripping surface is substantially flush with, inwardly offset from, and outwardly offset from said periphery, respectively, means for pivoting said rocking component in said range, including a cam track which is stationary with respect to said support and extends about said rotary axis, and a cam follower on said rocking component which follows said cam track and pivots said rocking component in said range in dependence on the configuration of said cam track, a gripping component having a second gripping surface and mounted on said rocking component for tilting relative thereto about a tilting axis to and from a gripping position in which said first and second gripping surfaces grip the respective sheet between themselves, and means for tilting said gripping component as a function of the pivoting movement of said rocking component in said range relative to said advancing cylinder; said cam track being so configurated that said rocking component reaches said intermediate position thereof during the pivotal movement opposite to said direction when said first gripping surface is substantially at said location of said support during the rotation of said advancing cylinder in said direction, and said first gripping surface of said rocking component comes to a brief substantial standstill at and relative to said location of said support during the pivotal movement of said rocking component opposite to, and during the rotation of said advancing cylinder in, said direction; at least one abutment on said support; said rocking component having at least one engaging portion which contacts said abutment during said substantial standstill of said first gripping surface of said rocking component, a front stop component mounted on said support and having at least two front stops which stop the leading edge of the respective sheet at said location of said support; said abutment being rigidly connected to said front stop component; said front stop component including a shaft which mounts said front stops and said abutment on said support for joint pivoting in and out of the trajectories of movement of the respective sheet and of said engaging portion, respectively; and further comprising means for controlledly pivoting said front stop component about said shaft, including a control cam track on said advancing cylinder, a control lever rigid with said front stop component, and a control roller rotatably mounted on said control lever and following said control cam track.

13. A combination as defined in claim 12, wherein said control cam track is so configurated that said abutment is pivoted out of contact with and out of the trajectory of said engaging portions immediately prior to the commencement of movement of said rocking component in said direction following said substantial standstill of said first gripping surface thereof.

14. A combination as defined in claim 13, wherein one of said rocking and front stop components is mounted on mounting means having limited resilient yieldability.

15. A combination as defined in claim 14, wherein said control cam track has a single, outwardly facing cam surface; and wherein said controlledly pivoting means includes a spring which urges said control roller into contact with said cam surface and thus provides said limited resilient yieldability.

16. A combination as defined in claim 14, wherein said control cam track is an annular control cam recess which receives and confines said control roller; wherein said mounting means of said rocking component includes a pivot shaft mounted on said advancing cylinder for pivoting about said pivot axis in dependence on said pivoting means for said rocking component; and wherein said mounting means having limited resilient yieldability is provided between said pivot shaft and said rocking component.

17. A combination as defined in claim 16; wherein said mounting means having limited resilient yieldability includes a bifurcated bracket rigid with said pivot shaft, and at least one spring arranged intermediate said bracket and said rocking component and urging the latter towards a given position thereof relative to said bracket.

18. In an offset printing machine, a combination comprising a support; means for guiding a leading edge of a respective sheet to be advanced through and printed upon in the printing machine to a predetermined location of said support; an advancing cylinder mounted on said support for rotation in a given direction about a rotary axis and having a periphery which moves past said location during the rotation of said advancing cylinder, and a hollow interior which opens onto said periphery; and means for transferring the respective sheet to a predetermined position on said periphery, including a rocking component having a first gripping surface thereon, means for mounting said rocking component in said hollow interior for pivoting in and opposite to said direction relative to said advancing cylinder about a pivot axis offset toward said periphery from and parallel to said rotary axis, in a range between a first terminal position and a second terminal position through an intermediate position in which said first gripping surface is substantially flush with, inwardly offset from, and outwardly offset from said periphery, respectively, means for pivoting said rocking component in said range, including a cam track which is stationary with respect to said support and extends about said rotary axis, and a cam follower on said rocking component which follows said cam track and pivots said rocking component in said range in dependence on the configuration of said cam track, a gripping component having a second gripping surface and mounted on said rocking component for tilting relative thereto about a tilting axis to and from a gripping position in which said first and second gripping surfaces grip the respective sheet between themselves, and means for tilting said gripping component as a function of the pivoting movement of said rocking component in said range relative to said advancing cylinder; and said tilting means of said gripping component including a cam track segment rigid with said advancing cylinder and extending about said pivot axis, and a push member articulated to said gripping component and extending therefrom substantially along said rocking component into contact with said cam track segment.

19. In an offset printing machine, a combination comprising a support; means for guiding a leading edge of a respective sheet to be advanced through and printed upon in the printing machine to a predetermined location of said support; an advancing cylinder mounted on said support for rotation in a given direction about a rotary axis and having a periphery which moves past said location during the rotation of said advancing cylinder, and a hollow interior which opens onto said periphery; and means for transferring the respective sheet to a predetermined position on said periphery, including a rocking component having a first gripping surface thereon, means for mounting said rocking component in said hollow interior for pivoting in and opposite to said direction relative to said advancing cylinder about a pivot axis offset toward said periphery from and parallel to said rotary axis, in a range between a first terminal position and a second terminal position through an intermediate position in which said first gripping surface is substantially flush with, inwardly offset from, and outwardly offset from said periphery, respectively, means for pivoting said rocking component in said range, including a cam track which is stationary with respect to said support and extends about said rotary axis, and a cam follower on said rocking component which follows said cam track and pivots said rocking component in said range in dependence on the configuration of said cam track, a gripping component having a second gripping surface and mounted on said rocking component for tilting relative thereto about a tilting axis to and from a gripping position in which said first and second gripping surfaces grip the respective sheet between themselves, and means for tilting said gripping component as a function of the pivoting movement of said rocking component in said range relative to said advancing cylinder; and said tilting means of said gripping component including a toggle-lever arrangement articulated to said gripping component and to a reaction point provided on said advancing cylinder.

20. A combination as defined in claim 19, wherein said toggle-lever arrangement includes a first toggle lever rigid with said gripping component and a second toggle lever pivotally connected to said first toggle lever at one end and to said reaction point at the other end; and wherein said reaction point is substantially radially offset from said pivot axis.

21. A combination as defined in claim 20, wherein said rocking component extends along a plane which includes said pivot axis and extends therefrom toward said periphery; and wherein said second toggle lever extends along a substantially radial line of said advancing cylinder which passes through said reaction point and which encloses a predetermined angle in said direction with said plane, when said gripping component is in said gripping position thereof relative to said rocking component.

22. A combination as defined in claim 19, wherein said tilting means of said gripping component further includes means for changing the position of said reaction point relative to said advancing cylinder to control the tilting movement of said gripping component around said gripping position thereof in the absence of relative pivoting movement of said rocking component with respect to said advancing cylinder, including a changing cam track on said support, and a changing cam follower which follows said changing cam track and is operatively connected to said reaction point.

23. A combination as defined in claim 22, wherein said changing means further includes means for mounting said reaction point of said advancing cylinder for movement in a part-circular path about said pivot axis.

24. A combination as defined in claim 23, wherein said changing cam track is so configurated that said gripping component is accelerated away from and retarded toward said gripping position as compared to the tilting movement thereof attributable to the action of said tilting means as a function solely of the pivoting movement of said rocking component in said range.

* * * * *